United States Patent [19]

Woods, Jr.

[11] 4,017,200

[45] Apr. 12, 1977

[54] HIGHWAY LANE DIVIDER BARRIER AND APPARATUS FOR SHIFTING THE SAME

[76] Inventor: Frank W. Woods, Jr., P.O. Box 16434, San Francisco, Calif. 94116

[22] Filed: Apr. 28, 1976

[21] Appl. No.: 681,054

[52] U.S. Cl. ..... 404/6; 404/9; 404/12

[51] Int. Cl.[2] ..... E01F 13/00

[58] Field of Search ..... 404/6, 9, 1, 12, 13, 404/14

[56] References Cited

UNITED STATES PATENTS

| | | | |
|---|---|---|---|
| 1,203,006 | 10/1916 | Keenan | 404/6 X |
| 2,143,433 | 1/1939 | Curtis | 404/1 |
| 2,182,697 | 12/1939 | Jelinek | 404/6 |
| 2,260,051 | 10/1941 | Pardee | 404/12 |
| 2,287,685 | 6/1942 | Jelinek | 404/12 |
| 2,931,279 | 4/1960 | Wiswell | 404/13 |
| 3,245,327 | 4/1966 | Wasley | 404/12 |
| 3,263,578 | 8/1966 | Pilcher | 404/13 |
| 3,391,620 | 7/1968 | Mahoney | 404/6 |
| 3,958,890 | 5/1976 | Ferrari | 404/9 |

*Primary Examiner*—Nile C. Byers
*Attorney, Agent, or Firm*—Naylor, Neal & Uilkema

[57] ABSTRACT

A barrier for placement intermediate two adjacent highway lanes. Apparatus for transferring the barrier from a location intermediate two lanes to a location intermediate two other lanes so as to accommodate differing traffic flow patterns for different times of day and different traffic conditions.

6 Claims, 8 Drawing Figures

FIG. 2.

HIGHWAY LANE DIVIDER BARRIER AND APPARATUS FOR SHIFTING THE SAME

BACKGROUND OF THE INVENTION

1. Field of the Invention

This invention relates to a barrier for separating two adjacent highway lanes and to an apparatus for transferring the barrier to a location between two different lanes as may be necessary to accommodate different traffic flow patterns.

2. Description of the Prior Art

U.S. Pat. No. 1,184,447 discloses a vehicle barrier that can be vertically reciprocated between a lower position at which its upper extremity is flush with the road surface and an upper position at which it extends above the road surface.

U.S. Pat. No. 3,276,333 discloses a road screen which is adapted for permanent installation in a median strip between two roadway lanes for reducing the headlight glare from a vehicle traveling in an opposite direction.

U.S. Pat. No. 3,391,620 discloses a movable traffic barrier which can be moved laterally to adapt the highway on which it is installed to different traffic flow patterns.

U.S. Pat. No. 3,698,692 discloses a modular fence construction composed of a plurality of U-shaped members.

U.S. Pat. No. 3,788,001 discloses a lawn edging structure for forming a barrier between two ground surface areas.

SUMMARY OF THE INVENTION

Many highways that extend to and from urban areas are multiple lane highways. It is standard practice to arrange the direction of traffic flow on such highways to expedite the traffic flow for all conditions. For example, in a six-lane roadway, it is standard practice to utilize four of the lanes for traffic flow toward the urban area during morning hours, the other two lanes being for traffic leaving the urban areas; and, then, to reverse the traffic flow during the evening hours so that four of the six lanes carry traffic away from the urban area. This procedure expedites traffic flow, but involves substantial expense in that, two or more times per day, a crew of workmen must rearrange lane markers, such rearrangement being achieved, in the known prior art, substantially by manual operations. These operations, in addition to requiring a large crew, are slow and disrupt traffic flow during the time that the lanes are being rearranged. For example, in the six-lane highway mentioned above, the two central lanes of the highway are obstructed to traffic flow for periods of time up to and exceeding one-half hour during the period of lane rearrangement. This procedure also has the disadvantage that it does not provide an effective safety barrier between lanes of traffic moving in opposite directions.

An object of the present invention is to provide a highway lane barrier which is very strong but which can be conveniently and quickly moved by a minimal crew. This object is achieved by forming a barrier of a plurality of channel members which are longitudinally slidable relative one another and which fit into slots formed in the roadway.

Another object is to provide an apparatus to facilitate rapid transfer of the above-mentioned barrier. The apparatus, according to the invention, includes a vehicle having a wedge-shaped ramp which is movable along the bottom of the slot. The ramp, in response to foward movement thereof, lifts the channel members upward into a transversely and diagonally extending path in the vehicle, after traverse of which the barrier forming members are deposited in a transversely spaced slot in the roadway.

A further object of the invention is to provide apparatus of the type described above in which slot filler plates can be simultaneously installed to fill a slot in the roadway from which the barrier is removed.

The foregoing, together with other objects, features and advantages, will be more apparent after referring to the following specification and the accompanying drawings.

DESCRIPTION OF THE PREFERRED EMBODIMENT

Figure 2:
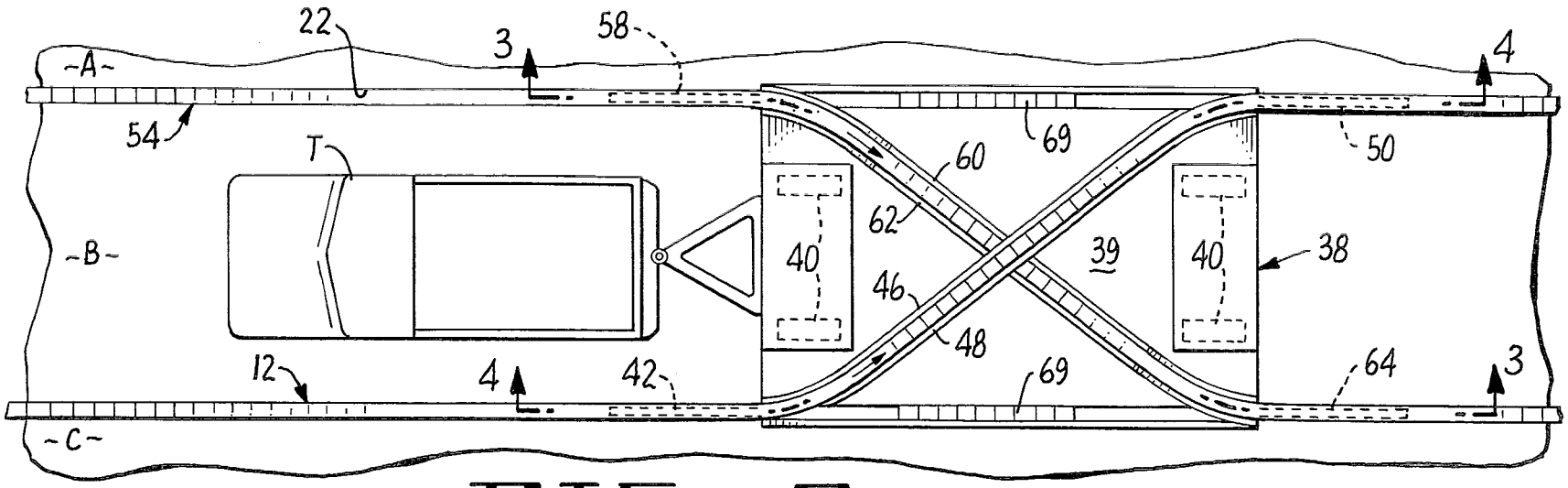
FIG. 2 is a plan view of the apparatus of FIG. 1.
Figure 3:
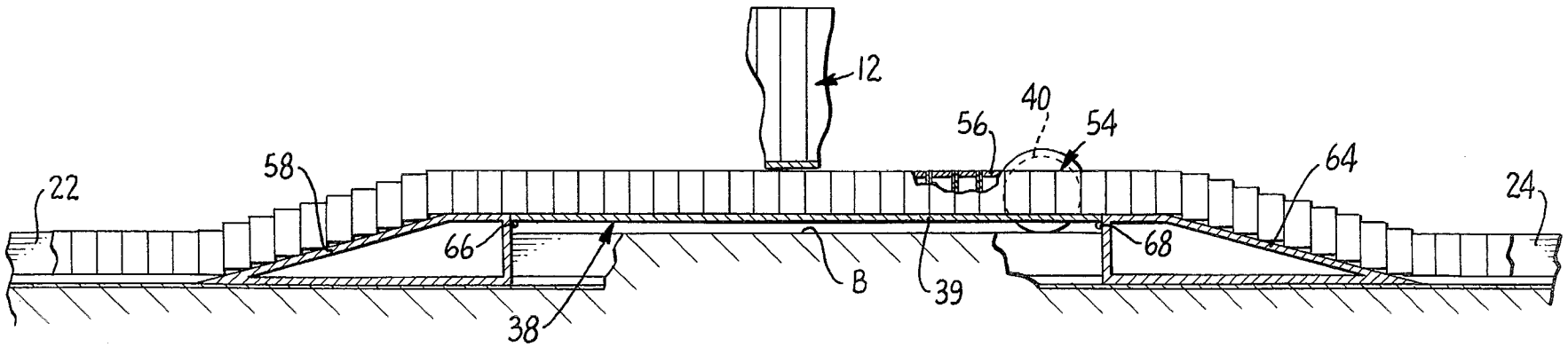
FIG. 3 is a cross-sectional view taken generally along the plane designated by Lines 3—3 of FIG. 2.

Referring to FIG. 2, the present invention will be described in detail in connection with a highway having three lanes designated A, B and C. The explanation that follows hereinafter describes transfer of a lane barrier 12 from a position between lanes B and C to a position between lanes A and B.

Figure 6:
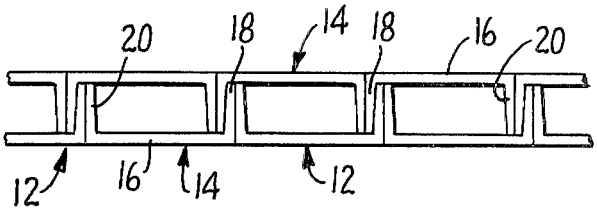
FIG. 6 is a plan view of a fragment of a lane barrier according to the invention.
Figure 5:
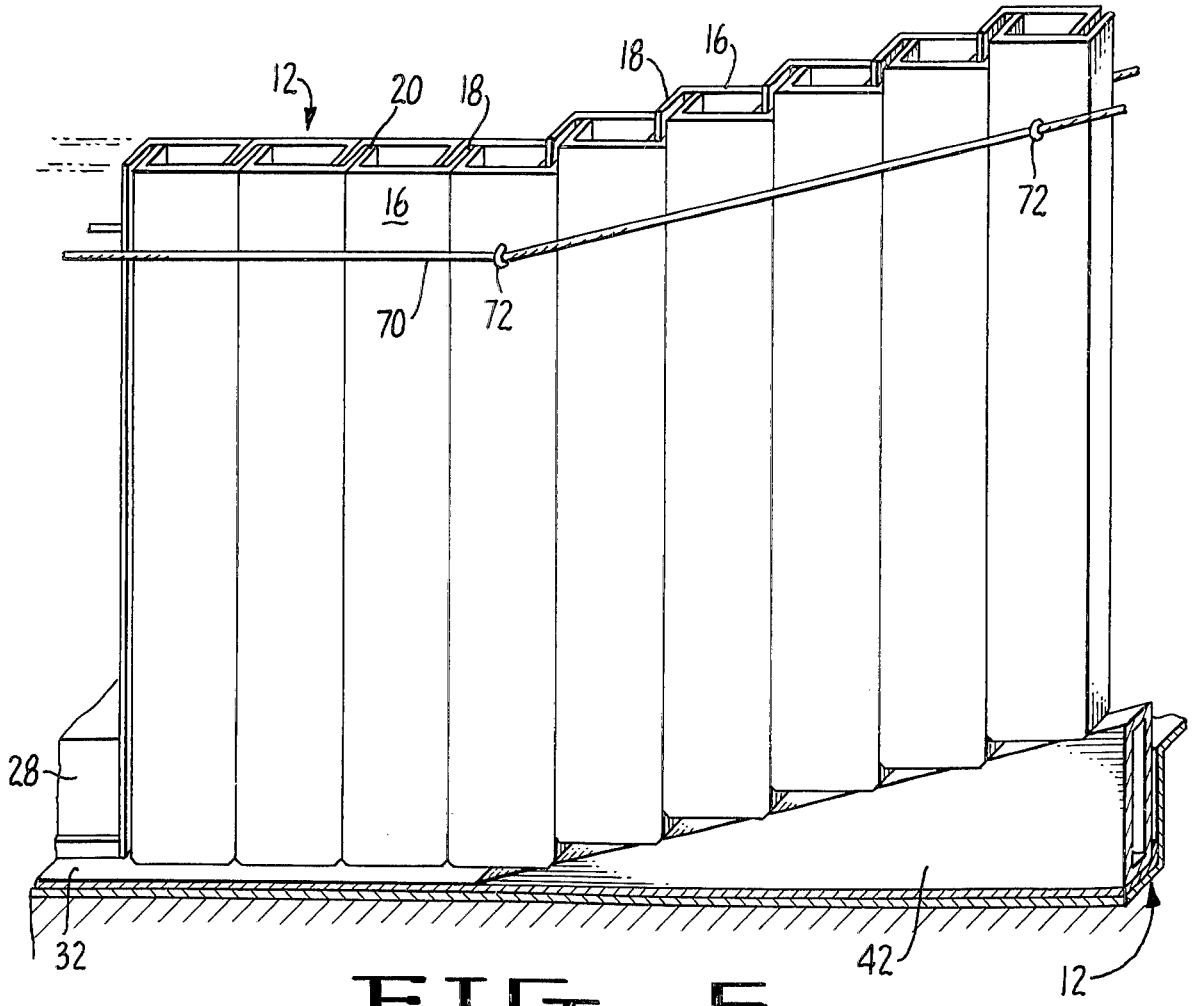
FIG. 5 is an elevational view of a barrier according to the invention during lateral transfer thereof on a highway surface.
Figure 7:
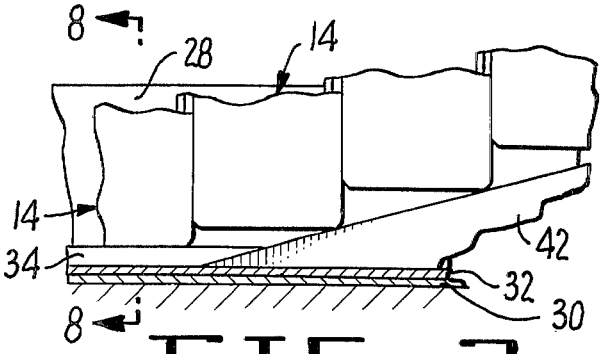
FIG. 7 is a fragmentary view at enlarged scale of a portion of FIG. 5.

Referring to FIGS. 5 and 6, barrier 12 is formed of a plurality of elongate channel members 14 that are formed of steel or like material of suitable strength. Channel members 14 are substantially identical and each includes a web 16 from opposite edges of which extend flanges 18 and 20 to form a generally U-shaped member. The external surfaces of flanges 18 and 20 are typically perpendicular to the exterior surface of web 16 so that, as seen most clearly in FIG. 6, a first group of channel members can be placed with the respective flanges therein in juxtaposition to form one surface of the barrier and a second surface of the barrier can be formed by a second group of U-shaped members disposed with their respective flanges in juxtaposition and oriented oppositely from the members in the first group. The barrier structure thus can resist compressive forces longitudinally of the barrier while permitting each of the respective members 14 to be axially slidable relative to all others without in any way impairing the strength of the barrier, particularly with regard to its ability to withstand lateral forces.

Figure 8:
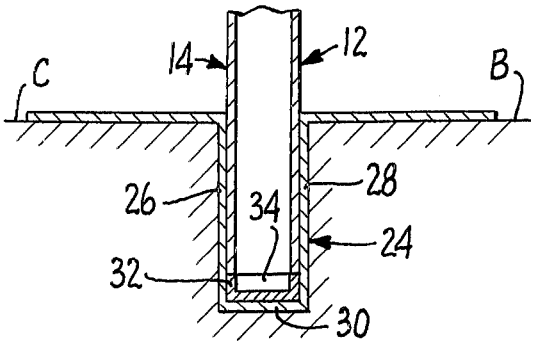
FIG. 8 is a cross-sectional view taken along a plane designated by Line 8—8 of FIG. 7.

Intermediate lanes A and B, the pavement surface in which the lanes are formed is provided with a slot 22, and intermediate lanes B and C is a similar slot 24. As seen most clearly in FIG. 8, slot 24 is defined by a vertically extending surface plate 26 and a vertically extending surface plate 28 which confront one another to define the slot. Plates 26 and 28 are preferably steel, or the like, to resist abrasion as barrier 12 is installed into and removed from the slots. Spanning the lower ends of vertical plates 26 and 28 is a horizontal plate 30 which defines the bottom of slot 24. As is clear from FIGS. 5 and 8, elongate channel members 14 have a vertical extent greater than the depth of the slots so that a substantial portion of the channel members extends above the pavement surface. For defining a space between the lower extremity of barrier 12 and the bottom of the slot, as defined by horizontal plate 30, a channel 32 can be installed in the bottom of the slot so as to define a clearance space 34 beneath the barrier.

Figure 1:
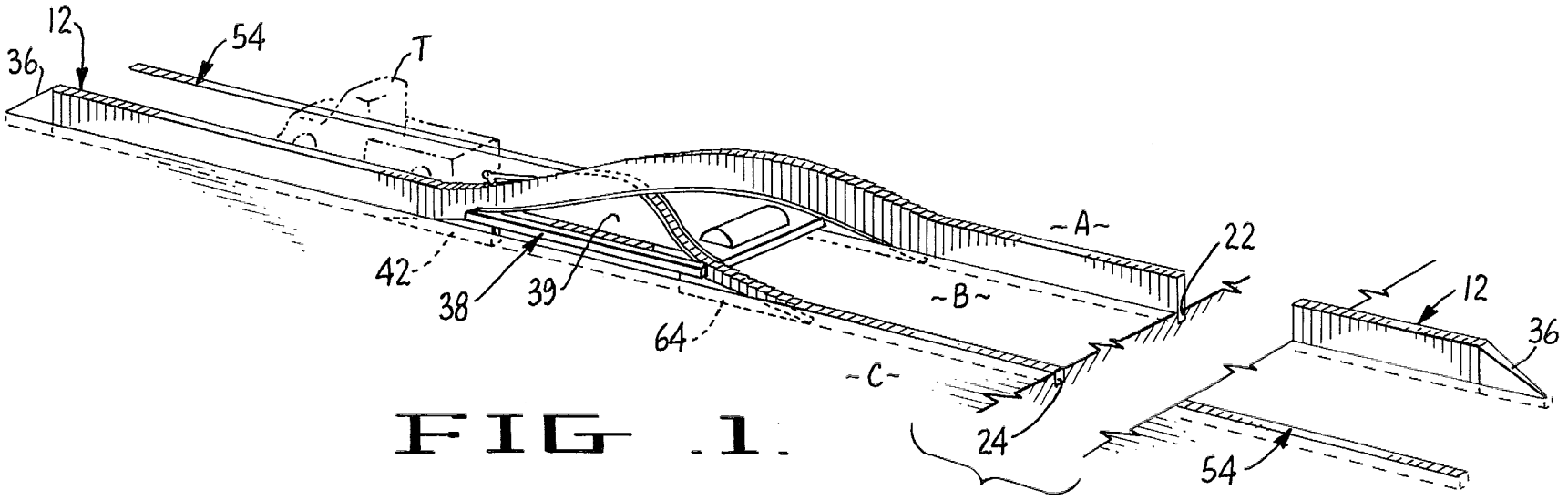
FIG. 1 is a partially schematic perspective view of a barrier according to the invention and the apparatus for transferring the barrier laterally on a highway.

As seen in FIG. 1, the longitudinal ends of slots 22 and 24 each receive a compression member 36 so that compressive forces on barrier 12 will not longitudinally displace the barrier within the slot.

The apparatus for transferring barrier 12 between slots 22 and 24 is designated generally by reference numeral 38. The apparatus includes a frame 39 which is supported for movement on the pavement by wheels 40, and which has a width corresponding to the transverse space between slots 22 and 24, such space corresponding to the width of traffic lane B. In cases where it is desirable to transfer barrier 12 over an interval equal to the width of two lanes, apparatus 38 is constructed with a correspondingly larger width dimension. Apparatus 38 can be self-powered or can be drawn along the highway by a truck or tractor T.

Figure 4:
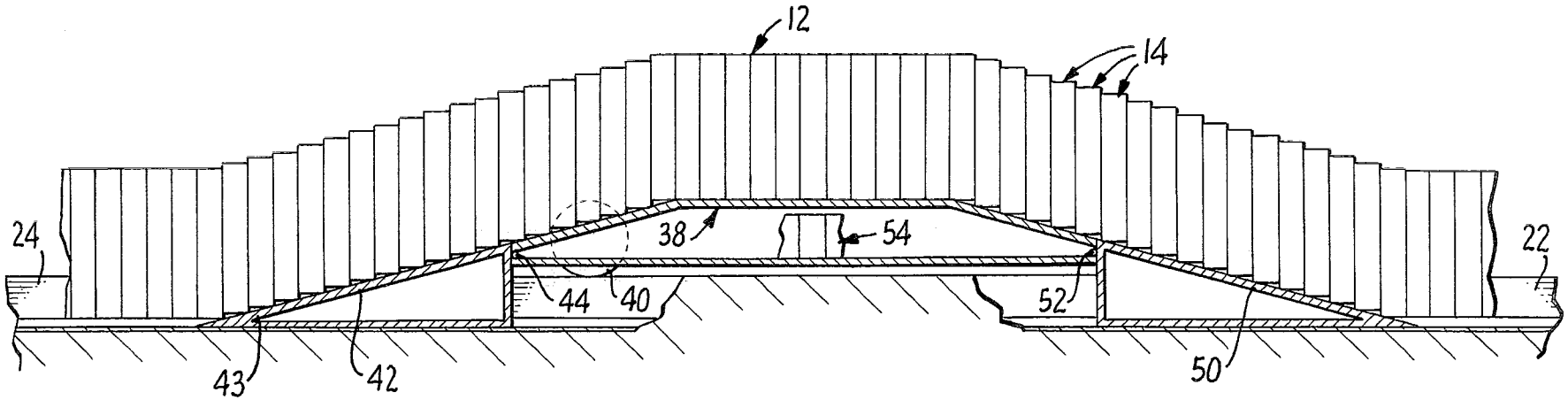
FIG. 4 is a cross-sectional view taken along the plane designated by Line 4—4 of FIG. 2.

For effecting transfer of barrier 12 from slot 24 to slot 22, apparatus 38 has, at the lefthand forward extremity thereof, a wedge-shaped ramp 42, which has a width less than slot 24 so that it can enter the slot and move therealong. Ramp 42 has a distal end 43 dimension for entry into clearance space 34 in slot 24. Ramp 42 is secured at its opposite end to frame 39 of apparatus 38 by means of a pivot joint 44 so that the ramp can be lowered to the operative position shown in FIG. 4 or can be raised to permit moving the apparatus away, after transfer of barrier 12 has been completed. In alignment with the upper end of ramp 42, which is at a level above the surface of lane B, there is a channel or track, formed by parallel members 46 and 48 (See FIG. 2) which are fixed to frame 39 and extend diagonally across apparatus 38. At the rear lefthand corner of the apparatus is a substantially identical wedge-shaped ramp 50 which is pivotally mounted to frame 39 by a pivot connection 52. Advancement of apparatus 38 toward the left, as viewed in FIG. 2, causes elongate members 14 which define barrier 12 to be raised along ramp 44, thence along the track defined between members 46 and 48, and then down ramp 50 into slot 22 on the opposite side of lane B. Because of the construction of barrier 12, the compressive loads imposed on the barrier during such operation can be tolerated. Moreover, the members are laterally constrained throughout traverse of apparatus 38, thereby retaining the alignment of U-shaped members 14 shown in FIG. 6 throughout such traversal.

In the interest of safety, it is desirable to fill in slot 24 after barrier 12 is removed therefrom. For this purpose, the invention includes a filler strip 54 which is constructed substantially identically to barrier 12, except that the respective members of which filler strip 54 is formed have a length corresponding to the depth of slots 22 and 24 and the upper ends of the said members have plates 56 which lie flush with pavement surface on which lanes A, B and C are formed.

Referring again to FIG. 2, the forward righthand extremity of apparatus 38 has a wedge-shaped ramp 58 which functions substantially identically to ramp 42 in that, in response to forward movement (i.e., leftward, as viewed in FIG. 2), filler members 54 move upwardly along the surface of the ramp. On frame 39 of apparatus 38, there is a track formed by plates 60 and 62, which confine the members constituting filler strip 54 to diagonal movement across apparatus 38. The track formed by plates 60 and 62 is vertically spaced from the track formed by plates 26 and 28 so that barrier 12 and filler strip 54 can simultaneously move across frame 39. At the rearward righthand extremity of apparatus 38 is a ramp 64 having a sloped surface along which the members forming filler strip 54 move into slot 24. Ramps 58 and 64 are pivotally mounted to vehicle 38 at respective pivot axes 66 and 68 so that those ramps can be pivotted upward when it is desired to move apparatus 38 away from the roadway.

In describing the operation of the present invention, it will be assumed that, as shown at the lefthand end of FIG. 2, barrier 12 resides in slot 24 between lanes B and C and filler strip 54 resides in slot 22 intermediate lanes A and B. It will also be assumed that the apparatus 38 is positioned at the righthand extremity of the roadway, and that the righthand compression member 36 and a limited number of the individual members of barrier 12 and filler strip 54 have been manually removed to afford sufficient space for ramps 42, 50, 58 and 64 to be lowered into slots 22 and 24 by pivotal movement of the ramps about their respective pivotal axes. As so conditioned, with the ramps in the lowered positions, apparatus 38 is moved leftward, as viewed in FIG. 2, in response to force supplied by truck T so that the barrier 12 and the filler strip 54 travel up their respective ramps, travel transversely and diagonally of apparatus 38, and are deposited into the opposite slots. Such action can continue quite rapidly, once motion is indicated, so as to substantially reduce the time during which traffic flow is impeded. Moreover, it will be noted that, because apparatus 38 is confined totally to traffic lane B, traffic movement on lanes A and C is not impaired. When the apparatus reaches the lefthand end of the roadway, the members of the barrier 12 and filler strip 54 remaining at the leftmost ends of the slots 24 and 32 and the compression member 36 at the leftmost end of the slot 24 are manually removed, ramps 42, 50, 58 and 60 are pivoted upward, apparatus 38 is moved to the side of the roadway, and barrier and filler members are manually placed within the empty spaces at the ends of the slots 22 and 24. For the latter purpose, magazines 69 of extra barrier and filler members are provided on the apparatus 38.

The foregoing operation would be reversed to transfer the barrier and filler members in the opposite direction. This reversal simply amounts to progressing the apparatus 38 from left to right, as viewed in FIG. 2, rather than from right to left.

In certain instances, it may be desirable to provide along barrier 12 a tension cable 70 which is supported at intervals along the barrier by U-bolts 72 which are fixed to the outer surface of the webs 16 of some of the U-shaped members 14. The cables distribute forces should a vehicle impinge on the barrier and facilitate guidance of elongate members 14 through the channel defined on apparatus 38 and along the track defined by plates 46 and 48.

It is also anticipated that the outwardly exposed side walls of the barrier members might be altered in shape to act as deflectors in the event of impact by a vehicle. For example, the individual barrier members might be provided with laterally extending skirts positioned to diverge downwardly and outwardly over the position of the road surface immediately adjacent the slot within which the members are received.

Thus, it will be seen that the invention provides an improved highway lane barrier and an apparatus for rapidly transferring the barrier between different locations on a highway with a minimal amount of time and labor. Moreover, the barrier is of such substantial strength, because of the U-shaped channel members, both singly and in combination, as to withstand the force of, for example, the impact of a runaway automobile or other vehicle. Obviously, the height of the barrier 12 can be established as desired, as can the specific construction of the various parts of the apparatus embodying the invention.

From the foregoing description, it should be appreciated that the barrier and filler members are under compression during the transfer operation. This results because, in either direction of movement of the apparatus 38, the members at the ends of the slots towards which the apparatus is progressing are anchored (i.e., in engagement with the ends of the slots). As a result, no tension connection between the members is necessary. The lack of such a tension connection, as well as the interchangability of the respective members, is particularly advantageous in that it facilitates replacement of individual members in the event of damage and minimizes "chain reaction" damage to the entire string of barrier members in the event of lateral impact. It should also be appreciated that, as shown in FIGS. 1 and 2, the apparatus 38 and truck T always move in the direction of traffic in the lane B and are shielded from oppositely directed traffic by the barrier 12. This arrangement greatly enhances the safety of the barrier transferring operation.

It should be understood that the invention is not intended to be limited to the specifics of the illustrated and described embodiment, but rather is defined by the accompanying claims.

What is claimed is:

1. Apparatus for forming a removable barrier between two adjacent road lanes on a pavement surface comprising a plurality of substantially identical elongate generally U-shaped rigid members each having a central web and a pair of flanges integral with the web and extending normal to the web from opposite ends of the web, said U-shaped members being arranged in first and second sets, the first set being positioned with the webs in coplanar relationship and the respective flanges of adjacent members in surface-to-surface juxtaposition, said second set being identically arranged and having the flanges thereof extending intermediate the flanges of the first set so that the flanges bear against the reverse side of the U-shaped members in the other set and so that said planar surfaces of respective said sets are spaced from one another by an amount substantially equal to the sum of the thickness of the two webs plus the length of the flanges, said pavement defining a slot intermediate said road lanes, said slot being formed by two vertical surfaces below the pavement surface that are spaced from another by a distance corresponding to the thickness of said barrier so as to slidably receive the U-shaped members forming said barrier in said slot, and means at opposite longitudinal ends of said barrier for compressively supporting the ends of said barrier, said member being vertically slidable relative one another.

2. Apparatus, according to claim 1, wherein said pavement surface defines a second slot parallel to first said slot and spaced therefrom by a distance corresponding to the width of one or more of said road lanes and means for transferring said barrier from first said slot to said second slot, said transferring means including a frame, means for supporting the frame for movement over the pavement surface intermediate said slots, means secured to one lateral extremity of said frame for elevating said U-shaped members from first said slot, said elevating means including a wedge-shaped ramp rigid with said frame and sized for entry into said slot, said ramp having an upward sloping surface along which said members are slidably transported in response to forward movement of said frame, a track on said frame in communication with said ramp for conveying the elongate U-shaped members therealong in response to forward movement of said frame, said track extending generally diagonally of said frame to a site at the rear thereof adjacent the opposite lateral extremity thereof, means secured to said frame at said site for entry into said second slot, last said means having a downward rearward sloping ramp for conveying said U-shaped members into said second slot in response to forward movement of said frame.

3. Apparatus for shifting barrier forming members from a first slot in a roadway to a second slot in a roadway laterally spaced from said first slot, said apparatus including a frame, means for supporting said frame for movement on said roadway intermediate said slots, an inlet ramp mounted at one forward lateral extremity of said frame and an outlet ramp mounted on said frame generally diagonally opposite said inlet ramp, said ramps being adapted to enter respective said slots simultaneously, and a track supported on said frame and extending between said inlet ramp and said outlet ramp so that in response to forward movement of said frame elongate members disposed in said first slot are raised along said inlet ramp and guided along said track for delivery to said outlet ramp and for introduction into said second slot.

4. Apparatus, according to claim 3, including means for mounting said ramps to said frame for upward movement so that said ramps can be disengaged from said slots to permit movement of said apparatus away from the roadway.

5. Apparatus, according to claim 3, including third and fourth ramps mounted to said frame at diagonally spaced corners thereof, said third ramp being disposed at the forward end of said frame opposite from first said ramp, said fourth ramp being disposed at the rear corner of said frame opposite said second ramp, and a track communicating said third ramp with said fourth ramp at a site vertically spaced from said track so that in response to forward movement of said frame filler strips can be removed from said second slot and transferred to said first slot after removal of said barrier from said first slot.

6. A method of providing a movable lane barrier between adjacent lanes of a roadway, said method comprising: forming longitudinally extending slots in the roadway at opposite sides of a lane; inserting a plurality of vertically extending individual barrier members in one of said slots, said members being disposed within said slot in side-by-side relationship and being vertically movable relative to one another; inserting a lifting ramp into the slot containing said members and moving said ramp longitudinally of said slot and progressively beneath the barrier members therein to lift said members from said slot; directing the barrier members so lifted across the lane having the slots on opposite sides thereof; and lowering the members so lifted into the slot on the side of said lane opposite the side from which the barrier members are being lifted.

* * * * *